United States Patent [19]

Schächter

[11] Patent Number: 4,773,849

[45] Date of Patent: Sep. 27, 1988

[54] VALVE ACTUATOR FOR POCKET LIGHTER

[76] Inventor: Friedrich Schächter, Draschestrasse 31, Vienna, Austria, A-1232

[21] Appl. No.: 50,161

[22] Filed: May 14, 1987

[51] Int. Cl.[4] ..... F23Q 1/02

[52] U.S. Cl. ..... 431/344; 431/277; 222/402.15

[58] Field of Search ..... 431/130, 131, 150, 254, 431/276, 277; 222/402.15, 5.3; 251/236, 242, 244, 245, 246

[56] References Cited

U.S. PATENT DOCUMENTS

| | | | |
|---|---|---|---|
| 2,836,044 | 5/1958 | Zellweger . | |
| 3,092,988 | 6/1963 | Meyers . | |
| 3,184,931 | 5/1965 | Yoshino . | |
| 3,208,244 | 9/1965 | Mandy . | |
| 3,213,647 | 10/1965 | Sakamoto | 431/276 |
| 3,229,486 | 1/1966 | Quandt | 431/150 |
| 3,263,456 | 8/1966 | Dexter . | |
| 3,280,599 | 10/1966 | Projahn . | |
| 3,382,028 | 5/1968 | Yoshinaga | 431/150 |
| 3,525,497 | 8/1970 | Zalar | 251/121 |
| 3,814,572 | 6/1974 | Nitta | 431/143 |
| 3,961,876 | 6/1976 | Chernock | 431/254 |
| 3,963,413 | 6/1976 | Lockwood et al. | 431/276 |
| 4,036,579 | 7/1977 | Margnissen | 431/131 |
| 4,157,891 | 6/1979 | Moriya | 431/344 |
| 4,177,646 | 12/1979 | Guadagnin et al. | 62/52 |
| 4,243,377 | 1/1981 | Schmid | 431/344 |
| 4,295,819 | 10/1981 | Sugiyama | 431/143 |
| 4,311,450 | 1/1982 | Camos | 431/344 |
| 4,322,549 | 6/1982 | Fuller | 431/344 |
| 4,496,309 | 1/1985 | Schächter | 431/344 |
| 4,560,345 | 12/1985 | Schächter | 431/344 |
| 4,595,352 | 6/1986 | Endelson | 431/254 |

*Primary Examiner*—Carroll B. Dority, Jr.
*Attorney, Agent, or Firm*—Pennie & Edmonds

[57] ABSTRACT

A fuel burning lighter, optionally having an adjustable flame height, comprising a supply of liquified gaseous fuel burner means communicating with the fuel supply, valve means positioned between the fuel supply and the burner means, means to provide first force to retain the valve means in a closed position to prevent gaseous fuel from passing therethrough, and means to provide second force less than the first force biasing the valve means toward an open position. The second force providing means normally provides sufficient force to move the valve means to an open position when the first force is relieved or released from acting upon the valve means.

30 Claims, 5 Drawing Sheets

VALVE ACTUATOR FOR POCKET LIGHTER

TECHNICAL FIELD

The invention relates to a lighter, particularly a disposable pocket lighter, wherein fuel flow is terminated when dirt, contamination, corrosion or erosion products prevent the valve mechanism of the lighter from properly operating.

BACKGROUND ART

Most lighters sold in the world market today include a moveable burner tube for opening and closing the valve thus allowing the fuel to flow to be ignited and establish a flame. Initial thumb movement rotates a spark wheel to provide sparks for igniting the fuel at the burner tube tip. Immediately thereafter, the burner tube, which moves relative to the housing in a clearance provided therefore, is lifted by a lever arm which is operated by the force provided by the continuing thumb movement contacting a thumb portion of the lever at an end opposite the burner tube. This force on the lever acts through a pivot point to move the burner tube to an open position which allows fuel to flow from the supply to the burner tip. When the fuel arrives at the burner tube tip, it is ignited by the sparks to establish a flame. When the lighter is not used, a spring normally located under the thumb portion of the lever arm provides sufficient force to the lever arm to maintain the valve in a closed position. This force is capable of withstanding exposure to the usual handling and carrying conditions without opening the valve at times when at which it is not desired.

The force of the spring is generally on the order of about one pound. This force is sufficient to overcome fuel pressure which attempts to open the valve (normally about 2–4 ounces) and for providing the incremental force required to seal the valve despite the possible existence of surface imperfections of the component parts in order to achieve a reliable seal enclosure or one burner (another 2–4 ounces), as well as to overcome forces caused by minor obstructions between the movable burner tube and the housing which obstructions may cause increased friction during movement of the burner tube (estimated at approximately 4 ounces or less).

As the lighter is repeatedly ignited, the action of the spark wheel on the flint generates abrasive dust particles, which may enter the clearance between the movable burner tube and the housing. Also, lint or other fabric dust from the pocket(s) of the clothing in which the lighter is carried represent a further source of dirt which can enter this clearance. The lighter will also experience various climatic conditions, both hot and cold, both in low and high humidity, as well as contact with fluids or foods, and such conditions provide a source of additional contaminants which may impede the proper movement of the burner tube between the open and closed positions.

If these contaminants provide a force of an additional 4–6 ounces, then the force of the spring will be insufficient to properly close and seal the valve. It is not practical to substantially increase the force of the spring because this would impede the normal thumb operation of the lighter, making it more difficult and more cumbersome to establish a flame. Furthermore, if the spring pressure is, in fact, increased, the lever arm or other component parts can be damaged due to overstraining.

Such higher forces can also cause irreversible deformation of certain component parts, particularly those of an elastomeric nature.

None of the prior art lighters of which the applicant is aware have recognized the totality of this problem. Accordingly, heretofor there have been no solutions for resolving such an unrecognized problem. The present application discloses a lighter which is rendered inoperative when contaminants accumulate between the burner tube and housing sufficient to impede the proper closing and sealing of the valve so as to prevent the escape of fuel when not intended. This result is obtained by providing a considerably smaller force for opening the valve in comparison to the force of the spring used to close the valve, in contrast to prior art lighters.

SUMMARY OF THE INVENTION

The present invention relates to a fuel burning lighter comprising a supply of liquified gaseous fuel; burner means communicating with the fuel supply; valve means positioned between the fuel supply and the burner means; means to provide first force to retain the valve means in a closed position to prevent gaseous fuel from passing therethrough; and means to provide second force opposed to and less than the first force to bias the valve means toward an open position. The second force generally ranges from 1/5 to ½ of the amount of the first force, with ¼ to ⅓ of that amount being preferred.

The valve means can include a valve seat and a valve seal operable between valve open and valve closed positions. The burner means is arranged and connected such that movement of the burner means from a first to a second position open and closes the valve means. Preferably, the means to provide the second force comprises resilient means positioned in engagement with the burner means in a manner to bias the burner means toward the valve open position. The resilient means may be an elastomeric member maintained in a compressed state by the first force.

In a preferred arrangement, the burner means includes laterally outwardly extending means and the elastomeric member is positioned in engagement with the outwardly extending means and maintained in a compressed state by the first force acting upon the outwardly extending means. This outwardly extending means may be an annular flange extending outwardly of the burner tube and the elastomeric means may be an elastomeric ring positioned about the burner means and in engagement with the lower surface of the annular flange. Normally, the burner tube has a generally circular cross sectional configuration and the elastomer ring is made of synthetic or natural rubber which is either molded or stamped from flat strip.

The resilient means preferably is a circular elastomeric ring having upper and lower substantially flat surfaces, and a cross sectional configuration defined by an inner wall and an outer wall concentric with the inner wall. The inner and outer walls each have a concave configuration to thereby minimize the change of the biasing force between valve open and valve closed positions. Advantageously, this elastomeric ring is dimensioned and positioned to prevent entry of foreign matter within the clearance surrounding the burner means.

The ring is slightly compressed to provide sufficient biasing force for opening the valve means when the ring is allowed to expand to its original configuration. The non-compressed thickness of the ring generally would be compressed between about 0.008 to 0.016 inches so as to provide an opening force of about 3 to 8 ounces. Generally, the ring is stamped from a sheet in such a manner to form inner and outer concentric side walls each having a predetermined concavity.

Such stamping is accomplished by a controlled operation which provides the preferred and predetermined concavities of the sidewalls of the final rings as viewed in the cross-section and as will be described hereinbelow. It is also within the scope of this invention to use more than one elastomeric ring in order to provide a less progressive second force.

In an alternate embodiment, the resilient means comprises a metallic spring positioned in engagement with the burner means and maintained in a compressed state by the first force.

Usually, the valve means is connected to the burner tube to form a burner tube assembly. Thus, movement of the burner tube assembly correspondingly moves the valve means between open and closed positions.

BRIEF DESCRIPTION OF THE DRAWINGS

Further benefits and advantages of the invention will become apparent from a consideration of the following description given with reference to the accompanying drawings figures which specify and show preferred embodiments of the invention and wherein.

For the sake of clarity, all portions or parts of these lighters which are not necessary for an explanation of the invention have been omitted.

DETAILED DESCRIPTION OF THE PREFERRED EMBODIMENTS

The present invention avoids the disadvantages described hereinabove by providing a lighter with a valve that remains in a closed position when dirt or contamination is encountered which interferes with the proper operation of the lighter. Also, consistent and stable gas flow are achieved at reduced production costs.

Figure 1:
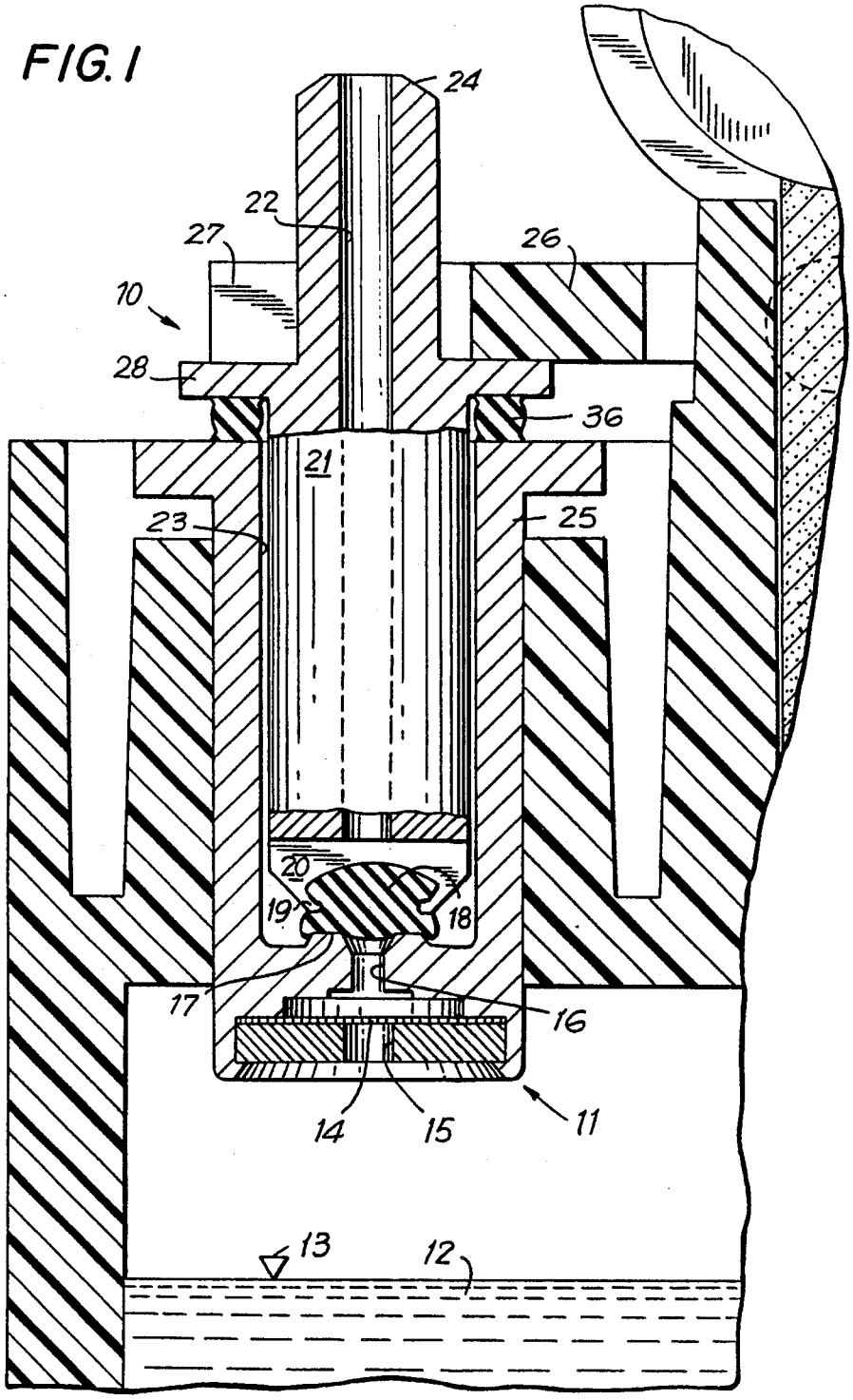
FIG. 1 is a partial cross-sectional view of a lighter according to the invention with the valve in the closed position.

Referring initially to FIG. 1, there is illustrated a fuel control assembly 10 for a pocket lighter in accordance with the invention. Liquified gaseous fuel 12 is maintained in a reservoir in the lower portion of the lighter. In this embodiment, sufficient space is shown between the normal upper level 13 of the fuel and the fuel flow control member 11 located at the lower end of the fuel control assembly 10. However, such space is not essential and the liquid level can contact the fuel control mechanism directly or via a wick or dip pipe for other fuel control assemblies without affecting the closing of the valve.

As one skilled in the art would realize when the valve is open, the fuel flows from the fuel tank 12, and through the fuel flow control member 11 and thereafter to the tip of the burner tube where a flame can be established by igniting the gaseous fuel in a manner that is well known in the art. Therefore, for explaining this invention, the term "upstream" will be used to designate components or sides of components which are first contacted by the fuel flowing from the fuel tank, while the term "downstream" will be used to designate components or sides of components which are subsequently contacted by fuel flowing to the burner tip.

The fuel flow control assembly 10 includes a burner tube 21 having a gas conducting conduit 22 and gas conducting bore 15 for directing gaseous fuel to the burner tip 24. The fuel initially passes through a fuel flow control member 11 which regulates the flow of fuel to the burner tip to prevent surges and provide consistent flow thereof. Suitable fuel flow control members include those described in U.S. Pat. Nos. 4,496,309 and 4,560,345, although other arrangements, with or without flame height adjustment, could be utilized without departing from the inventive features of the lighters disclosed herein. As is evident to one skilled in the art, lighters according to the invention may also utilize a dip pipe or wick.

A valve seal 18 is secured to the upstream end of the burner tube 21 and is used to prevent or allow the gaseous fuel to pass from the valve bore 16 to the burner tip 24. The valve seal 18 is held in a closed position by a spring (not shown, but see 30 in FIG. 3) acting on lever 26 which holds and maintains the burner tube 21 in a closed position whereby valve seal 18 covers the valve bore 16. A preferred material for the valve seal 18 is rubber and it is held securely on the end of the burner tube by crimping the ends 19 of the burner tube 21 around the valve seal 18. The burner tube 21 is preferably made of aluminum, zinc, copper or alloys thereof.

Figure 2:
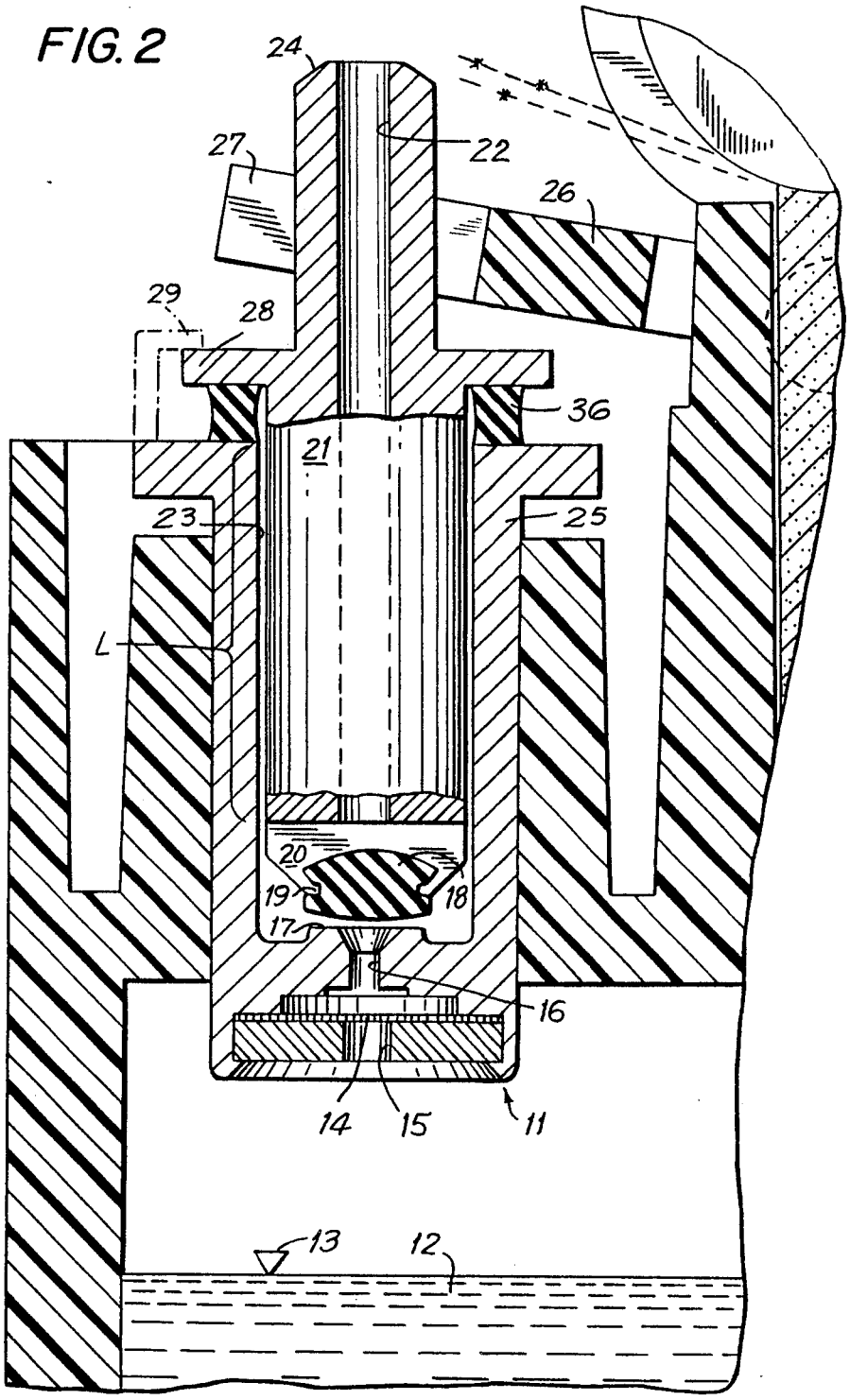
FIG. 2 is a partial cross-sectional view of the lighter of FIG. 1 with the valve in the open position.

Gaseous fuel from the supply 12 passes through a microporous membrane 14 thus reaching and filling the valve bore 16. When the lighter is not in operation, i.e., when fuel does not flow to the burner tip 24 to facilitate establishment and feed of a flame, valve seal 18 is maintained in a closed position in firm sealing contact relation with valve bore 16. When the burner tube 21 raises, space is provided between valve seat 17 and valve seal 18. Thus, fuel can flow from valve bore 16 around valve seal 18, thereafter through slot 20 and burner tube bore 22, to burner tip 24 and thereafter out of the lighter where a flame can be established. The amount of the clearance 23 in combination with the length L over which such clearance extends precludes passage of the gaseous fuel through the clearance space when the valve is in the open position as shown in FIG. 2. Thus, when valve seal is lifted off its seat 17, the fuel flows exclusively through the bore 22 of the burner tube 21 to its tip 24 to maintain a flame.

In some instances, the elastomeric ring 36 biasing the valve seal 18 toward the open position, and the surrounding structure, may be employed to provide additional sealing capability, for example by limiting the lift-off movement of flange 28 to maintain sealing contact between the ring 36 and the underside of the flange 28. However, such additional structure is purely optional due to the already effective prevention of passage of gaseous fuel through clearance 23 as noted above. Incorporation of such optional feature will also maintain the clearance free of any contaminants such as spark wheel debris which may otherwise seek entry into the clearance 23. Such additional structure may include an upward limit stop for flange 28, preferably attached to housing 25 as shown, for example, in dotted lines as 29 in FIG. 2. Such limit stop may also be optionally incorporated in the embodiment of FIG. 3 (not shown) to present excessive lift-off movement of valve seal 18.

Figure 3:
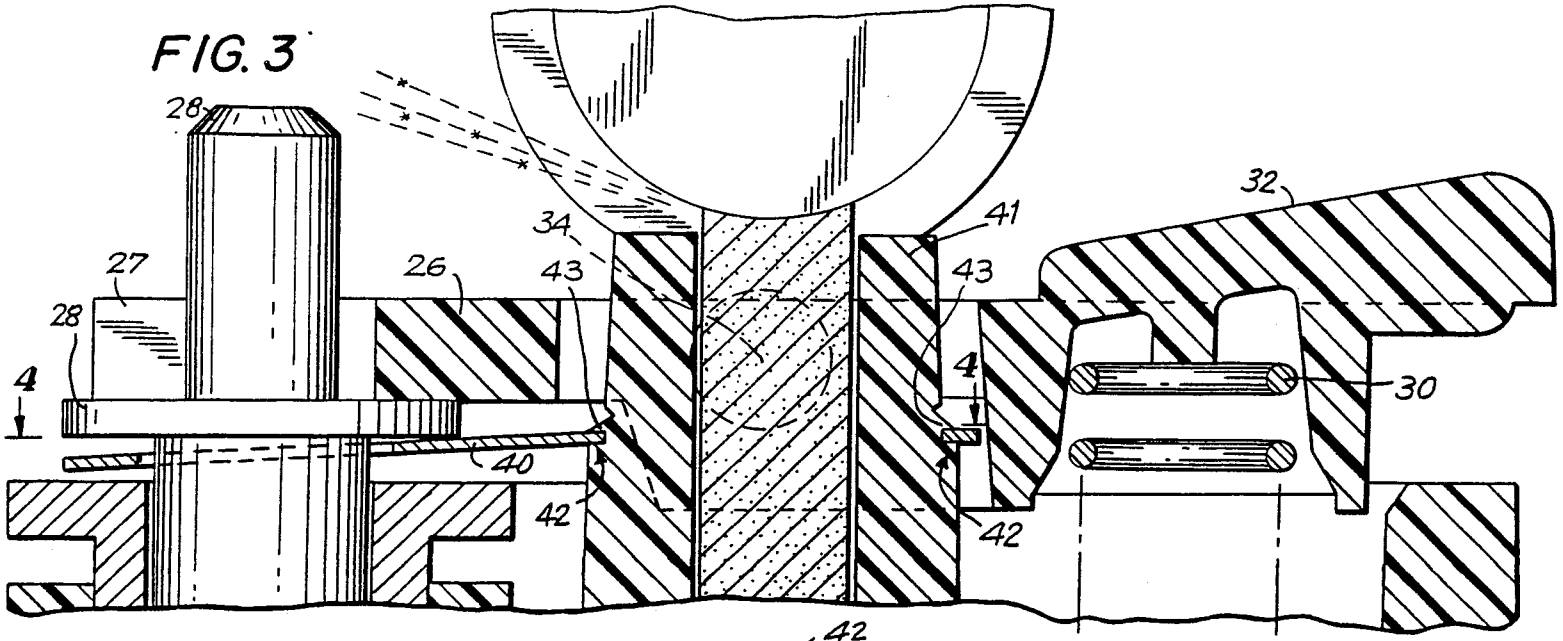
FIG. 3 is a partial cross-sectional view of a valve actuating mechanism of another lighter according to the invention.

As best illustrated in FIG. 3, the valve seal 18 is maintained in firm sealing contact relation with valve seat 17 by lever 26. Lever 26 presses against flange 28 which preferably is integral with burner 21 and pressed by a force generally on the order of approximately one pound supplied by spring 30. To open the valve, the user's thumb applies force to thumb portion 32 which forms part of the opposite end of lever 26. Thus, the lever 26 pivots around point 34 and, when force is applied to thumb portion 32 by the user's thumb, the lever 26 moves in an upward direction away from flange 28 of burner 21.

Referring once again to FIG. 1, when lever 26 moves away from flange 28, the closing force is relieved from flange 28, burner tube 21, and valve seal 18. The burner tube 21 is lifted upward by the action of the valve opening means, illustrated in this embodiment as elastomeric ring 36, to allow gas to flow from the supply 12 to the burner tip 24. Elastomeric ring 36 is preferably made of natural or synthetic rubber having sufficient resiliency to provide an upward force on the order of about 5 ounces. It has been found that the preferred force requirements for the valve opening means should generally range from between 1/5 and $\frac{1}{2}$, and preferably between $\frac{1}{4}$ and $\frac{1}{3}$, of the force provided by closing spring means 30. Thus, for lighters using other types of levers and spring arrangements, the force provided by the valve opening means or elastomeric ring 36 should be scaled accordingly.

As noted above, the force provided by this ring 36 should not be greater than that necessary only to overcome the resistance to separate valve seal 18 from the valve seat 17 due to sticking, as well as the resistance due to minor manufacturing imperfections in the components of the fuel control assembly 10, along with resistance caused by minor unavoidable dirt or dust particles which are typically encountered and which find their way into the narrow clearance 23 between burner tube 21 and housing 25. The upward force on flange 28 provided by elastomeric ring 36 thus raises the valve seal 18 to the most minimum distance which allows fuel from the supply 12 to pass to the burner tip 24 to establish a flame after ignition. Such distance is in the range of a few thousands of an inch depending upon the precision and tolerance of the component parts. This distance is provided by the movement of elastomeric ring 36 due to the relief of pressure from lever 26. This movement is due the recovery of elastomeric ring 36 after the compressive closing force provided by the lever 26 is removed.

FIG. 2 illustrates the lighter and burner tube in an open position whereby the fuel can travel from the supply 12 to the burner tip 24 for ignition and maintenance of a flame. The user's thumb provides downward movement on the thumb portion 32 of lever 36 and displaces lever end 27 a distance of about 0.1 inch, thus lifting it off the flange 28. The lever end 27 which is in communication with flange 28 of burner tube 21 does not necessarily have to encircle the burner tip 24. An open fork end at the lever end 27 is entirely suitable and in some cases preferred for ease of manufacture and assembly of the fuel control mechanism 10 of the lighter.

Referring again to FIG. 3, an alternate valve opening means is shown for proviing opening force on the burner tube 21. This means is shown in the form of a spring 40 which normally would be in a horizontal position. As noted above, the upward force provided by spring 40 is preferably on the order of between about $\frac{1}{4}$ and $\frac{1}{3}$ of that provided by spring 30 in closing the valve. The attachment portion 39 of spring 40 is positioned over flint guide 41 resting upon shoulder portions 42 and is held in position by displacing small portions 43 of material from flint guide 41. Such displacements can be made by staking or swaging the flint guide 41 with a sharp tool (not shown) in several locations. This procedure is preferred, since the widths of the marginal portions defining the attachment portion 39 of spring 40 is of the order of about 0.03 inch due in part to space limitations therearound. To simply press-fit the spring around the flint guide 41, for example, would tend to distort the attachment portion 39 of the spring 40.

Figure 4:
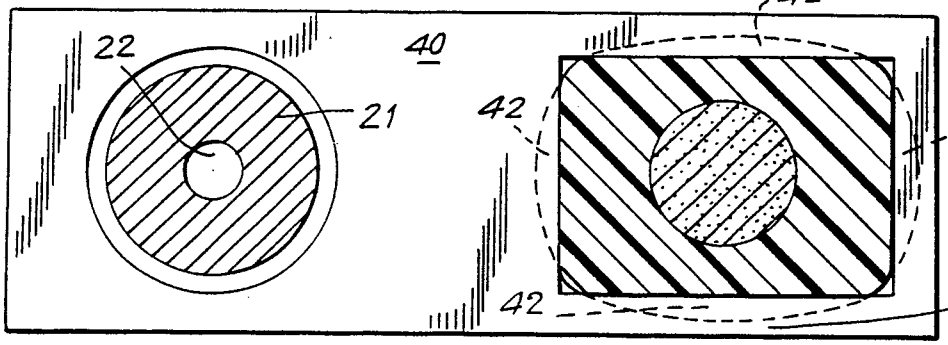
FIG. 4 is a detail of the valve opening spring of FIG. 3.

A detail of spring 40 is shown in FIG. 4. Advantageously, this spring 40 is stamped from a thin sheet of metal having sufficient strength to provide the desired force. As one skilled in the art would realize, depending upon the metal selected, the thickness of the spring 40 can be varied to achieve the proper forces desired.

Figure 5:
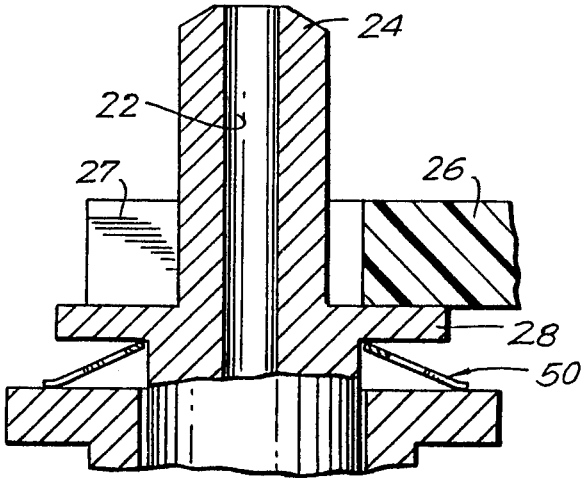
FIG. 5 is a partial cross-sectional view of another valve actuating mechanism according to the invention.
Figure 6:
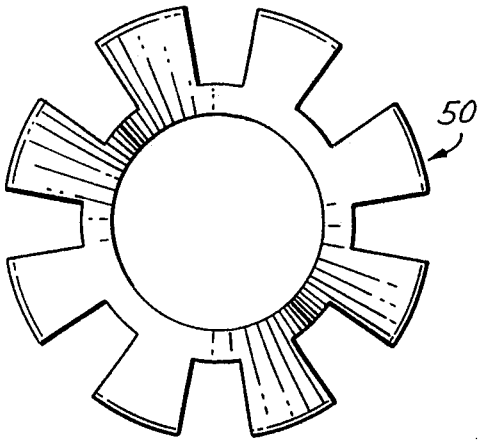
FIG. 6 is a detail of the valve opening spring of FIG. 5.

FIG. 5 shows a further embodiment of the invention with the upward force being supplied by cup spring 50. A detail of this spring 50 is shown in FIG. 6. Again, the spring 50 provides a very slight amount of lifting force to open the valve and allow fuel to flow from the supply to the burner tip thereof. This very slight upward movement is advantageous in that it exposes a much smaller area of the outer surface of the burner tube and minimizes the introduction dirt or other contaminants into the clearance 23 between the burner tube 22 and the housing 25.

Figure 7:
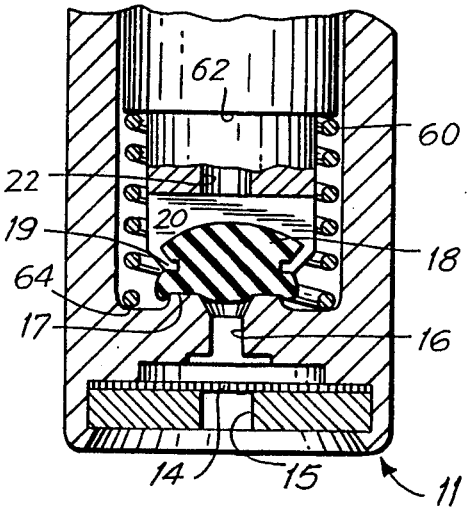
FIG. 7 is a partial cross-sectional view of an alternate valve actuating embodiment.

FIG. 7 illustrates an alternate embodiment of the opening force means of the invention, that being a coil spring 60. This coil spring 60 is placed below the burner tube in a manner such that engages a shoulder 62 and the lower portion of burner tube 21 and the base portion 64 below valve seal 18 and valve seat 17. As in the other embodiments, spring 60 provides the smallest amount of force necessary to open the valve and allow gas flow therethrough while satisfying the other force providing parameters described previously.

The coil spring 60 of FIG. 7 can also be replaced by the appropriate design and the use of the force providing elements of any of FIGS. 1-5. However, when provided on the inner portion of the housing, the coil spring arrangement has been found to be the simplest with respect to the design and manufacture of the valve burner tip and housing. In this embodiment, it is also possible to utilize the rubber ring of FIGS. 1 and 2 in the upper portion beneath flange 28, not for the purpose of providing an upward force but as a sealing member for minimizing the entry of dirt or other contaminants into the clearance tube and the housing. As noted above, by minimizing the entry of dirt or other contaminants from entering into this clearance, the gumming up the lighter from abrasive contaminants and or corrosion of the tube or housing is minimized, so that the lighter can provide the longest period of acceptable operation.

Figure 8B:
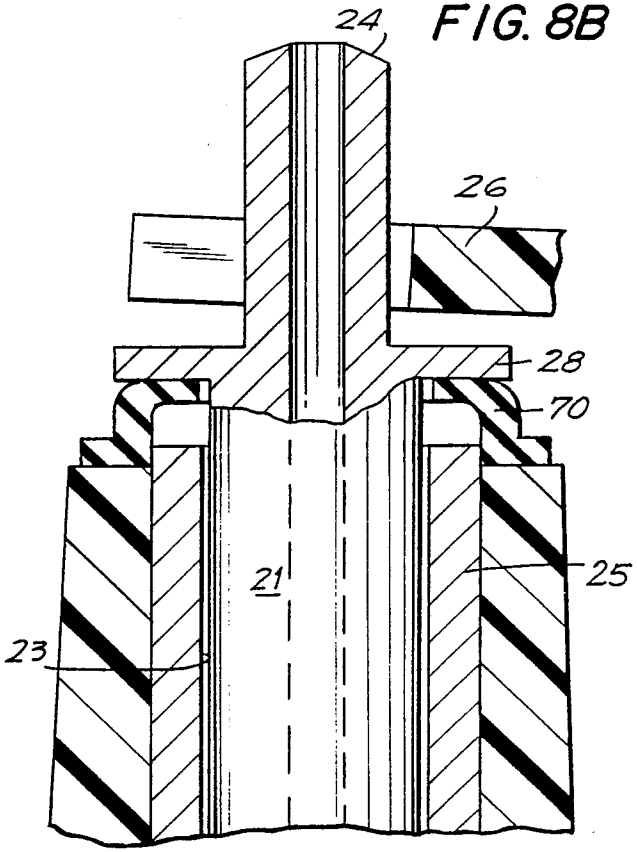
FIGS. 8A and 8B are partial cross-sectional views of still another embodiment of the invention with the burner tube shown in the closed and opened positions, respectively.
Figure 8A:
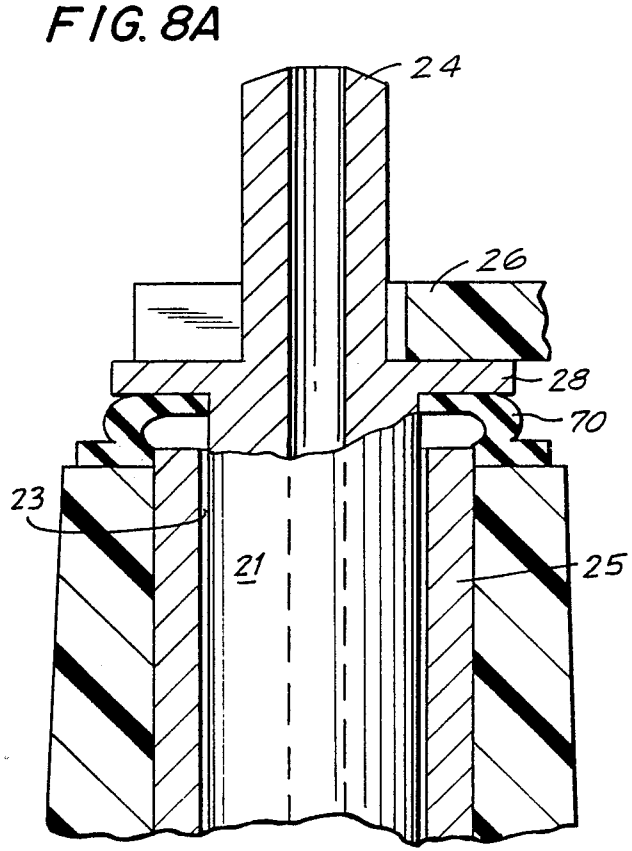

FIGS. 8A and 8B show an embodiment of the invention employing a cup shaped member 70 molded from elastomeric material and arranged in contacting engagement with flange 28 and housing 25 to ensure a reliable protection against contamination of the narrow clearance 23 as well as to provide a force biasing the valve toward the open position. Due to a suitable selection of the elastic properties and the shape said biasing force increases only by a relatively small amount when the burner tube 21 is moved from the open to the closed position. FIG. 8B shows the burner tube in the open position with the cup 70 relaxed. FIG. 8A shows the closed position.

As noted in the drawings, the lever 26 preferably includes a fork end around burner tip 24. If desired, it is also possible to utilize a circular ring portion on the end of the lever, rather than a fork, or any other suitable means for transferring the force provided by spring 30 to flange 28 and burner tube 21. Caution must be taken to assure that the lever 26 in its most raised position (see FIG. 2) is sufficiently distant from the burner tube tip 24 so as to not be affected (i.e., burned) by the flame.

In the event, however, that dirt contaminants or other impurities do enter into the clearance 23 between burner tube 22 and housing 25, the closing force provided by spring 30 would be sufficient to overcome resistance from contaminants so as to effectively close the valve. However, when the resistance caused by the contaminants exceeds the substantially lower force of the valve opening means (that is on the order of ¼ to ⅓ of that of the closing means), the valve would be prevented from opening, thus remaining in a closed position to prevent fuel from escaping from the supply tank. While this would render the lighter inoperative, it also provides safety in that fuel cannot continue to flow or escape from the supply 12 as it would in prior art lighters when contamination builds up to a point where the spring cannot return the burner tube 21 to a closed position after the burner tube 21 has been forced to an open position by thumb pressure. Such a result cannot be achieved if the lever 26 were used to lift the burner tube 21 since the force provided by a user's thumb is much greater than the closing force provided by spring 30. Accordingly, the valve seal and burner tube 21 can be forced to an open position where it would remain, being unable to return to a properly closed position when the thumb pressure is relieved, thus allowing fuel to escape from the supply.

If desired, the lighter of the invention can be provided with a nonadjustable flame or means for adjusting the flame to a predetermined flame height. Also, the normally used features provided by prior art lighters can be included to satisfy the desires of one skilled in the art.

While it is apparent that the invention herein disclosed is well calculated to fulfill the objects above stated, it will be appreciated that numerous modifications and embodiments may be devised by those skilled in the art and it is intended that the appended claims cover all such modifications and embodiments as fall within the true spirit and scope of the present invention.

What is claimed is:

1. A fuel burning lighter comprising:

a supply of liquified gaseous fuel;

burner means communicating with said fuel supply;

valve means positioned between said fuel supply and said burner means;

means to provide first force to retain said valve means in a closed position to prevent gaseous fuel form passing therethrough; and resilient elastomeric means compressed by said first force providing means so as to provide second force less than said first force for biasing said valve means toward an open position.

2. The fuel burning lighter of claim 1 wherein said second force is opposed to said first force and is between about 1/5 and ½ the amount of said first force.

3. The fuel burning lighter of claim 2 wherein said second force is between about ¼ and ⅓ the amount of said first force.

4. The fuel burning lighter of claim 1 wherein said valve means comprises a valve seat and a valve seal movable between valve open and valve closed positions.

5. The fuel burning lighter of claim 1 wherein said burner means is arranged such that movement of said burner means from a first to a second position opens said valve means.

6. The fuel burning lighter of claim 1 wherein said resilient elastomeric means is positioned in engagement with said burner means in a manner to bias said burner means toward said valve open position.

7. A fuel burning lighter comprising:

a supply of liquified gaseous fuel;

burner means communicating with said fuel supply;

valve means positioned between said fuel suply and said burner means;

means to provide frist force to retain said valve means in a closed position to prevent gaseous fuel form passing therethrough; and means to provide second force less than said first force, said means biasing said valve means toward an open position and comprising an elastomeric member positioned in engagement with said burner means and maintained in a compressed state by said first force.

8. The fuel burning lighter of claim 7 wherein said burner means includes laterally outwardly extending means and said elastomeric member is positioned in engagement with said outwardly extending means and maintained in a compressed state by said first force acting upon said outwardly extending means.

9. The fuel burning lighter of claim 8 wherein said outwardly extending means is an annular flange extending outwardly of a burner tube and said elastomeric member encircles said burner tube and is in engagement with the lower surface of said annular flange.

10. The fuel burning lighter of claim 9 wherein said burner tube has a generally circular cross sectional configuration.

11. The fuel burning lighter of claim 10 wherein said elastomer ring is made of synthetic or natural rubber which is either molded or stamped from flat strip.

12. A fuel burning lighter comprising:

a supply of liquified gaseous fuel;

a burner tube communicating with said fuel supply;

valve means positioned between said fuel supply and connected to said burner tube so as be operable between open and closed positions by corresponding movements of said burner tube;

means to provide first force to retain said valve means in a closed position to prevent gaseous fuel from passing therethrough; and resilient means comprising an elastomeric member in contact engagement with a portion of said burner tube to provide second force less than said first force, said resilient means biasing said valve means toward an open position.

13. The lighter of claim 12 wherein said resilient means is a circular elastomeric ring having upper and lower substantially flat surfaces.

14. The lighter of claim 13 wherein said circular ring has a cross sectional configuration defined by an inner wall and an outer wall concentric with said inner wall, said inner and outer walls each having a concave configuration to thereby minimize the change of biasing force between valve open and valve closed positions, said ring further being dimensioned and positioned to prevent entry of foreign matter within the clearance surrounding the burner means.

15. The lighter of claim 12 wherein said resilient means is maintained in a compressed condition to provide sufficient biasing force for opening said valve means when the resilient means is allowed to expand.

16. The lighter of claim 14 wherein the noncompressed thickness of said ring is compressed between about 0.008 to 0.016 inches so as to provide an opening force of about 3 to 8 ounces.

17. The lighter according to claim 12 wherein said resilient member is a ring stamped from a sheet in such a manner to form concave inner and outer concentric side walls each having a predetermined concavity.

18. A fuel burning lighter comprising:

a supply of liquified gaseous fuel contained with said lighter;

burner means supported within said lighter and communicating with said fuel supply;

valve means positioned between said fuel supply and said burner means, said valve means having a valve seat and valve seal movable between valve open and valve closed positions, said valve means further being connected to said burner means for corresponding movements between said valve open and valve closed positions when said burner means is correspondingly moved;

flange means extending laterally from said burner means;

means to provide first force to retain said valve means in a closed position to prevent gaseous fuel from passing therethrough, said first force being capable of being overcome by manually applied counteractive forces; and resilient elastomeric means positioned in engagement with the underside of said laterally extending flange means to provide second force less than said first force biasing said valve means to said open position and to prevent foreign matter from interfering with the opening and closing of the valve means.

19. A fuel burning lighter comprising:

a supply of liquified gaseous fuel;

a burner means communicating with said fuel supply;

valve means positioned between said fuel supply and said burner means;

means to provide first force to retain said valve means in a closed position to prevent gaseous fuel from passing therethrough; and means to provide second force opposed to and less than said first force to move said valve means to an open position only when siad first force is relieved, said second force providing means comprising an elastomeric member which is held compressed by the action of said first force upon said burner means to retain said valve means in a closed position, said member capable of expanding to provide said second force to move said burner tube upwardly to allow fuel to pass from said supply through said valve means to the burner tube as soon as said first force is released; said elastomeric member being configured and positioned in a manner to prevent foreign matter from interfering with the movements of said burner means for opening and closing the valve means.

20. The fuel burning lighter of claim 1 further comprising means to limit the opening movement of the burner means when said first force is relieved.

21. The fuel burning lighter of claim 20 wherein said limit means comprises stop means.

22. The fuel burning lighter of claim 4 wherein said valve seal includes elastomeric sealing means which is maintained under compression in the valve closed position to sealingly block passage of fuel from said supply to said burner means, such that when said first force is relieved, said elastomeric sealing means assists in moving the valve means to said valve open position.

23. The fuel burning lighter of claim 22 wherein said second force is opposed to said first force and is between about 1/5 and ½ the amount of said first force.

24. The fuel burning lighter of claim 22 wherein said burner means has a generally circular cross sectional configuration and a hollow chamber therein for passage of said fuel.

25. The fuel burning lighter of claim 7 further comprising a housing, a portion of which includes an aperture for guiding the movement of said burner means, said aperture extending from an inner end near a valve seat to an outer face at an upper end of said housing, said aperture and an external surface of the burner means defining a narrow clearance to allow said burner means to be movably disposed therein and guided between said closed and open positions, said narrow clearance having a length sufficient to provide resistance to fuel flow and to prevent substantial escape of fuel therethrough when said valve is open, so that substantially all fuel flows through a central bore provided in said burner means when said elastomeric member moves said valve means to said open position.

26. The fuel burning lighter of claim 25 wherein said elastomeric member prevents entry of foreign matter into said clearance by peripheral contact engagement with said burner means and said outer face of the housing.

27. The fuel burning lighter of claim 26 wherein said burner means includes flange means located above said outer face of the housing and in engagement with an upper surface of said elastomeric member.

28. A fuel burning lighter comprising:

a supply of liquified gaseous fuel including a valve bore for passage of fuel;

burner means communicating with said fuel supply;

valve means including an elastomeric portion positioned between said fuel supply and said burner means;

means to provide first force to retain said valve means elastomeric portion in a closed position over said valve bore to prevent gaseous fuel from passing therethrough; and resilient elastomeric means for providing second force less than said first force for biasing said valve means toward an open position and for preventing foreign matter from interfering with the opening and closing of the valve means; said resilient elastomeric means and valve means elastomeric portion cooperating to move said valve means to an open position to allow fuel to flow from the fuel supply to the burner means when said first force is removed.

29. The fuel burning lighter of claim 28 further comprising means to limit opening movement of the burner tube when said first force is relieved.

30. The fuel burning lighter of claim 29 wherein said limit means comprises stop means.

* * * * *